US005950855A

United States Patent [19]

Li et al.

[11] Patent Number: 5,950,855

[45] Date of Patent: Sep. 14, 1999

[54] MULTIFUNCTIONAL HARD PACKING BOX

[76] Inventors: Lingqun Li; Lingfa Li; Singfeng Shen; Baocheng Zhao, all of No. 143 Youhanan Road, Urumqi, Xijiang, 830000, China

[21] Appl. No.: 08/849,331

[22] PCT Filed: Dec. 7, 1995

[86] PCT No.: PCT/CN95/00096

§ 371 Date: Sep. 16, 1997

§ 102(e) Date: Sep. 16, 1997

[87] PCT Pub. No.: WO96/18546

PCT Pub. Date: Jun. 20, 1996

[30] Foreign Application Priority Data

Dec. 10, 1994 [CN] China ..... 94247812

[51] Int. Cl.[6] ..... B65D 6/22

[52] U.S. Cl. ..... 220/4.33; 220/4.01

[58] Field of Search ..... 220/4.33, 4.01, 220/6, 7

[56] References Cited

U.S. PATENT DOCUMENTS

| | | | |
|---|---|---|---|
| 2,550,088 | 4/1951 | Sayer | 220/6 |
| 3,398,850 | 8/1968 | Kennard | 220/6 |
| 3,570,801 | 3/1971 | Moritz | 220/4.33 |
| 3,572,535 | 3/1971 | Kinzi | 220/4.33 |
| 3,917,102 | 11/1975 | Repetti | 220/4.33 |
| 4,083,464 | 4/1978 | Burnett | 220/4.33 |
| 5,429,259 | 7/1995 | Robin | 220/4.33 |
| 5,762,222 | 6/1998 | Liu | 220/4.33 |

FOREIGN PATENT DOCUMENTS

| | | |
|---|---|---|
| 2L92228207 | 5/1993 | China . |
| 2L94208402 | 12/1994 | China . |
| 2L93240742 | 5/1995 | China . |
| 2040267 | 8/1980 | United Kingdom . |

*Primary Examiner*—Joseph M. Moy
*Attorney, Agent, or Firm*—David and Raymond; Raymond Y. Chan

[57] ABSTRACT

The present utility model relates to a multifunctional packing box. In which the peripheral connecting positions of the box walls are connected by the "Ω" type hinges, and there are locking clips fixed in the upper and lower ends of the hinges. The peripheral edges of the box cover and box bottom are fixed by the grooved metal rim, and there are locking teeth fixed inside the box cover and box bottom. When in use, the box body is pushed off, and the upper and lower edges of the box body are inserted into the metal grooves of the box cover and box bottom which are buckled, the locking clips with the locking teeth are meshed and locked. Once the box cover and box bottom are opened, then some traces will remain on the box cover which are not recoverable. In the mean time, for transporting the empty, the box body can be closed in randomly from left or right. This packing box is convenient to use and has a good safety feature, so that it is an ideal substitute for the current packing boxes.

2 Claims, 4 Drawing Sheets

MULTIFUNCTIONAL HARD PACKING BOX

TECHNICAL FIELD

The present invention relates to an article packing box, especially a multifunctional hard packing box.

BACKGROUND ART

There are mainly four kinds of packing box at present which are used widely in the different productive and managing field, that is, the corrugated carton, woody box, synthetic plate box and plastic box. These four packing boxes are monofunctional, their performances such as sealing, dustproof, rainproof, sun-proof and waterproof etc, are poor. In the mean time, they could be imitated easy. U.S. Pat. No. 2, 550, 088 has provided a packing box which is connecting the peripheries of box walls with each other by the hinges; A new packing box is designed by a chinese patent 94208402.0 in which the imitation could be prevented. The present invention based thereon developes now once more a multifunctional hard packing box through many experiments.

DISCLOSURE OF INVENTION

The object of the present invention is to provide a multifunctional hard packing box which is characterized by that the peripheral box walls are connected with each other by the "Ω" type hinges, and through the "Ω" type hinge holes fixed by the rivets; The peripheral edges of upper box cover and lower box bottom are fixed with one-pass moulding grooved metal rim by the rivets. There are locking clips fixed by use of rivets in the upper and lower ends of two blade of the "Ω" type hinges. There are locking teeth fixed in the place where the corner angles inside the upper box cover and lower box bottom are coinciding with the place where the locking clips are fixed on the "Ω" type hinges. The locking clips and the locking teeth are meshed and locked with each other. Due to the multifunctional hard packing box in the place where the connecting positions of the peripheral box walls are in use of the "Ω" type hinges, the connected box body can be closed in randomly from left or right. There are one-pass moulding grooved metal rims fixed in the peripheral edges of the upper box cover and lower box bottom. The connection of the upper box cover and lower box bottom with the box body is locked by mesh of locking clips with locking teeth each other. When in use, the upper box cover and lower box bottom are opened. Therefore, some traces will remain on the box cover which are not recoverable. As a result, it is in full play which the imitation can be prevented. In the mean time, the present box is resultful in some respects such as rainproof, sun-proof, anti-rat bite, sealing and dustproof. In the transportation, the box cover, the box bottom and the closed in box body are transported in the manner of stackup. When in use, the box body is pushed off, then recovered, and the box cover and box bottom are buckled subsequently.

BRIEF DESCRIPTION OF DRAWINGS

FIG. 5 is a schematic drawing of an open ring of the present invention. wherein

Figure 1:
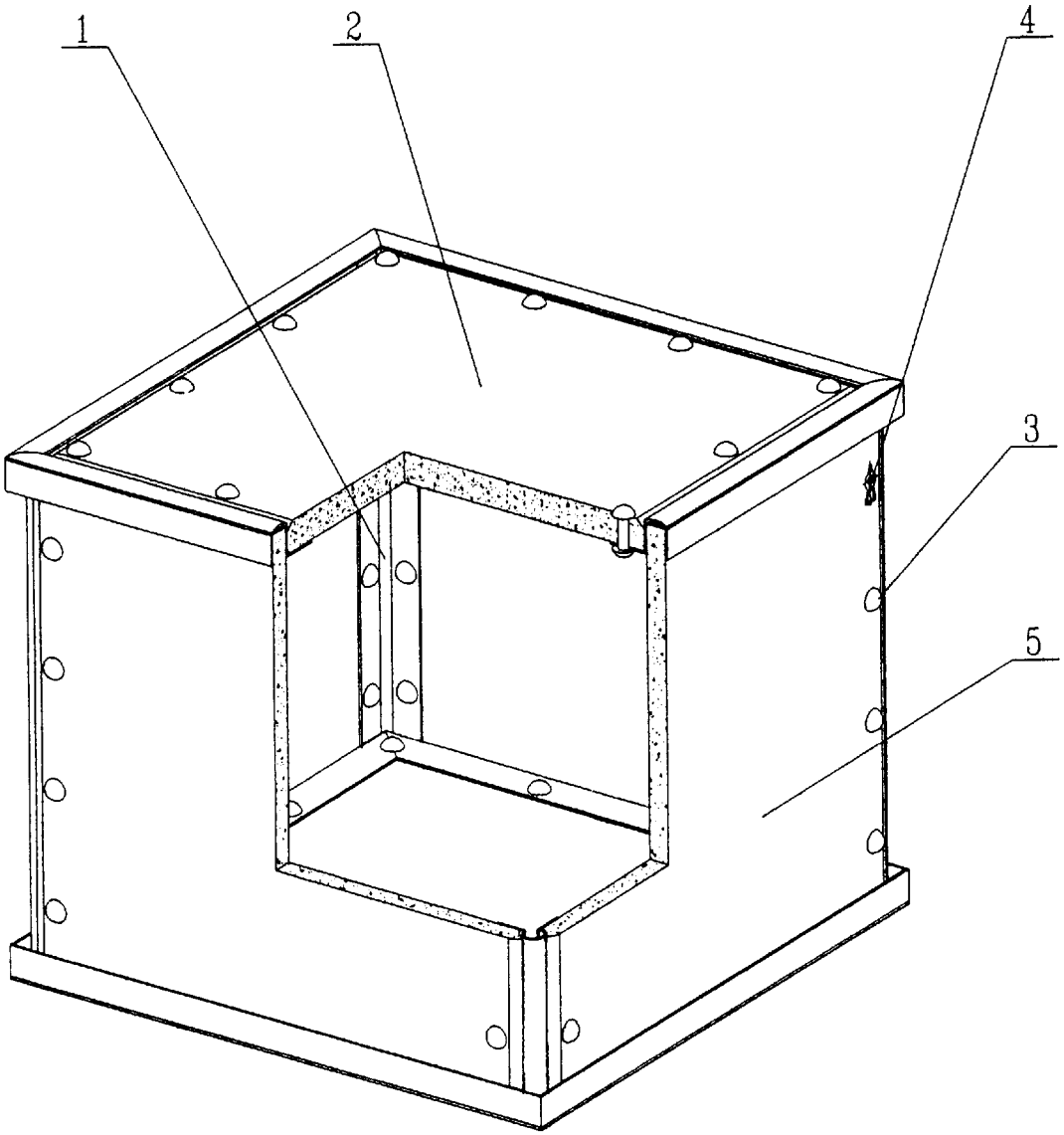
FIG. 1 is a front elevation of the present invention.
Figure 2:
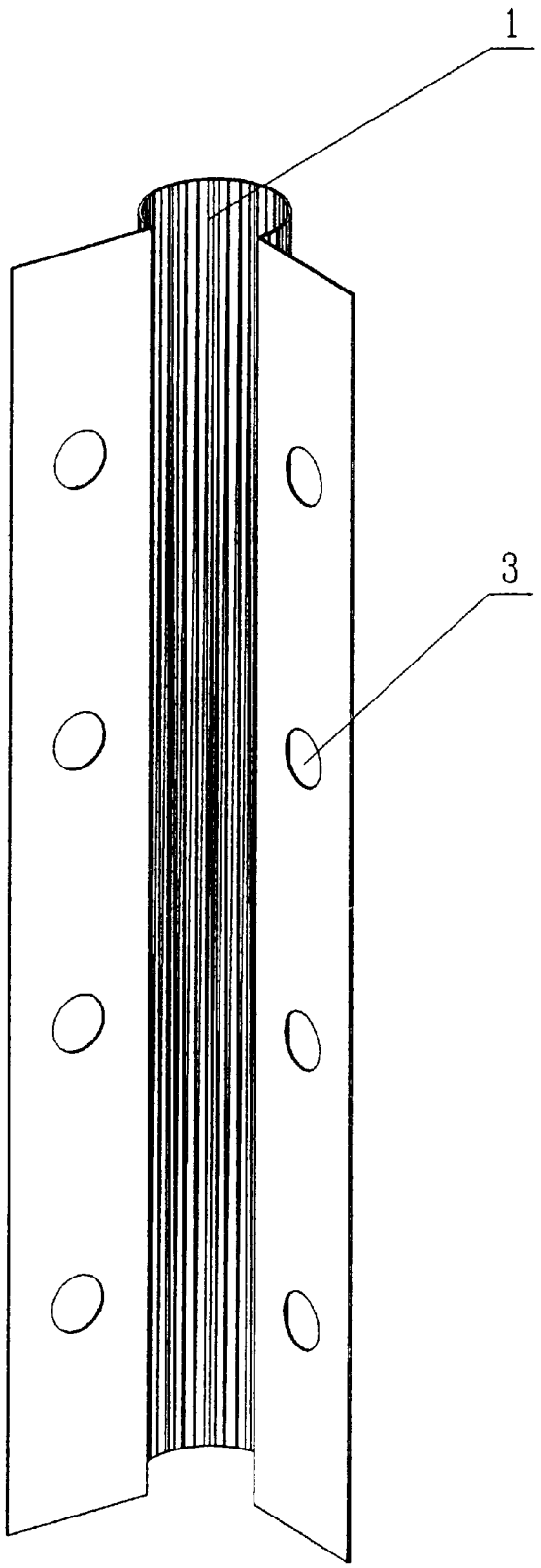
FIG. 2 is a schematic drawing of a "Ω" type hinge of the present invention.
Figure 3:
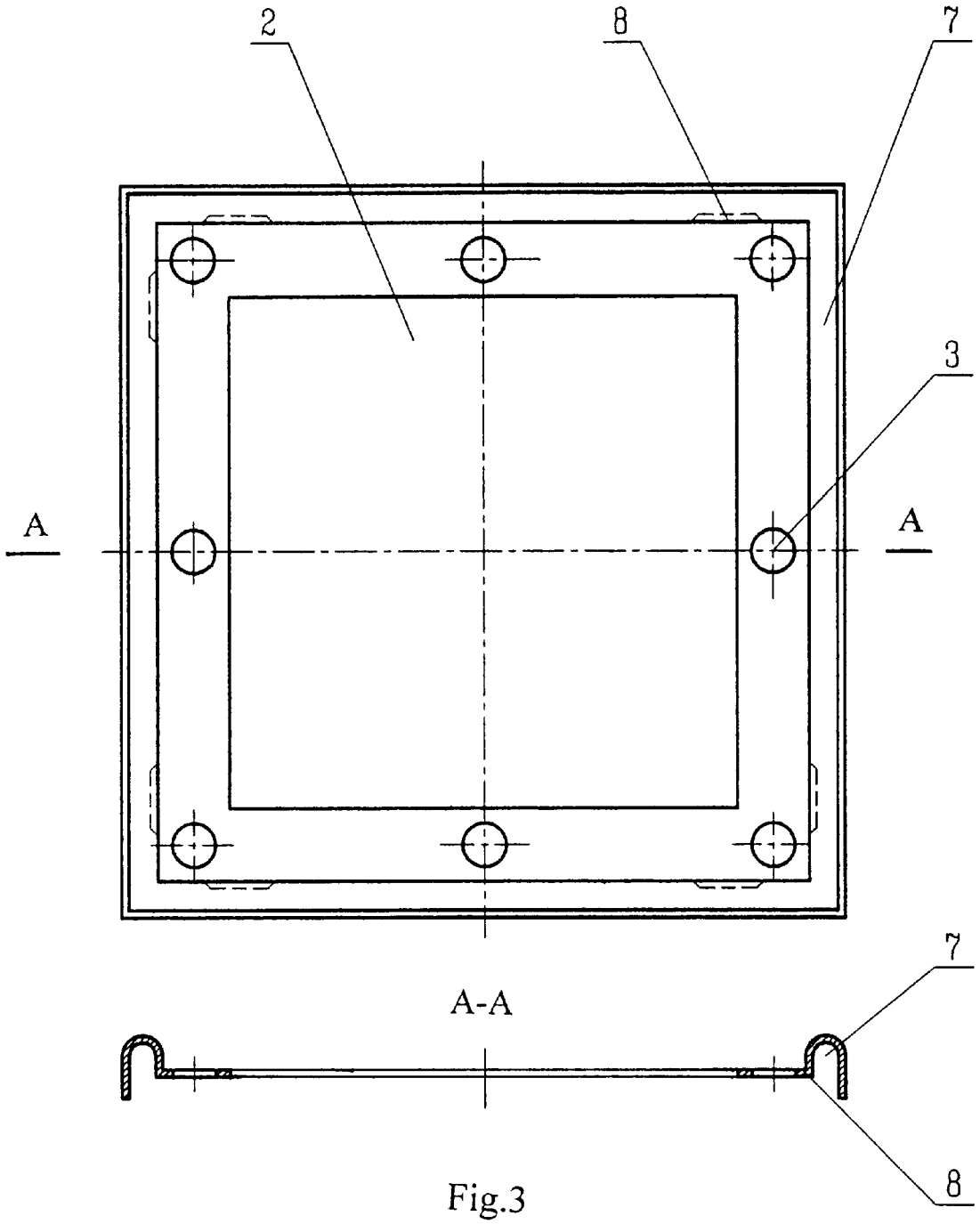
FIG. 3 is a schematic drawing of the box bottom and box cover of the present invention.
Figure 4:
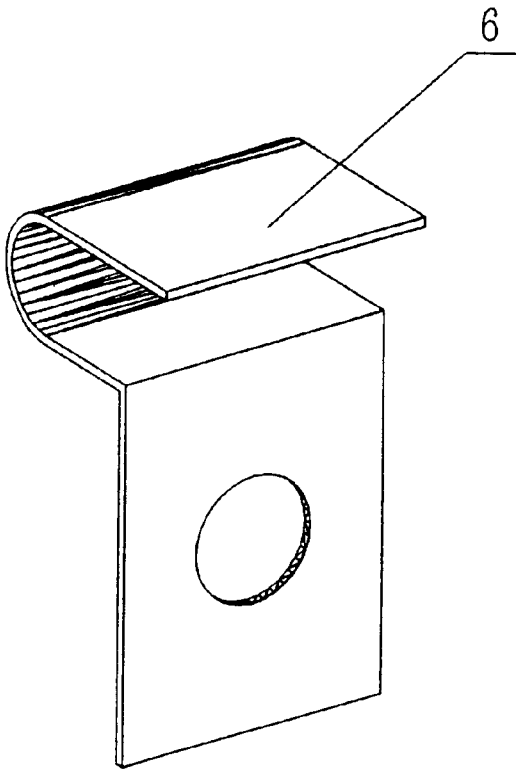
FIG. 4 is a schematic drawing of a locking clip of the present invention.
Figure 5:
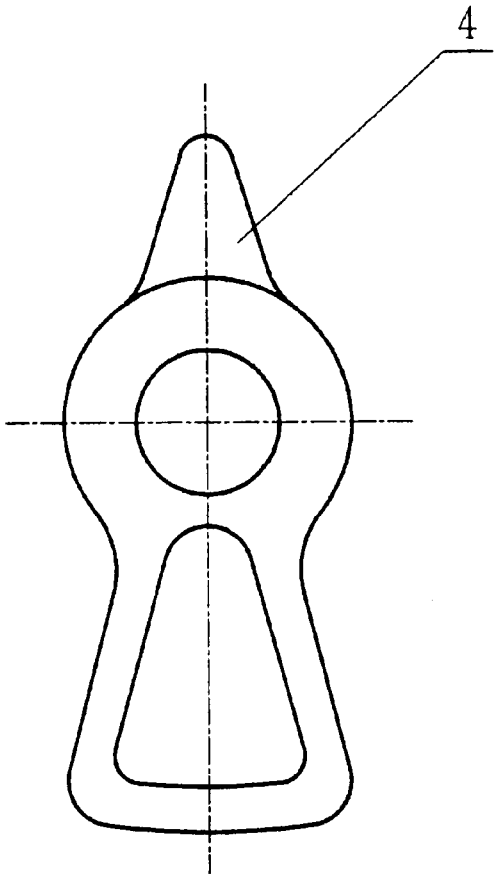

| | |
|---|---|
| (1) - "Ω" type hinge | (2) - box bottom, box cover |
| (3) - hinge hole | (4) - open ring |
| (5) - box wall | (5) - locking clip |
| (7) - metal rim | (8) - locking tooth |

BEST MODE FOR CARRYING OUT THE INVENTION

According to the multifunctional hard packing box designed by the present invention, the peripheral box walls (5) are mainly connected with each other by use of "Ω" type hinges (1), and through the "Ω" type hinge holes (3) fixed by rivets. The peripheral edges of the upper box cover and lower box bottom (2) with the one-pass moulding grooved metal rims (7) are fixed by rivets. There are locking clips (6) fixed by use of rivets in the upper and lower ends of two blades of the "Ω" type hinges (1). There are locking teeth (8) fixed in the place where the corner angles inside the upper box cover and lower box bottom (2) are coinciding with the place where the locking clips (6) are fixed on the "Ω" type hinges (1). The locking clips (6) and the locking teeth (8) are meshed and locked with each other. There is an open ring (4) fixed at the upper end of the box walls (5). When in use, the open ring (4) is taken out, and the locking clips (6) are pushed away by use of the top end of the open ring, the locking clips will then pull out of the upper box cover or the box bottom, and the box is opened. Therefore, some traces will remain on the box cover which are not recoverable. In transporting the empty, the box body which is closed in randomly from left or right, and together the box cover and box bottom are transported in the manner of stackup. When in use, the box body is pushed off, the upper and lower peripheral edges of the box body are inserted into the metal grooves of the rims of the box cover and box bottom, then it is buckled. The locking clips and the locking teeth are buckled and locked with each other. This box is convenient to use with a good safety feature, so that it is an ideal substitute for the current packing boxes.

In the manufacturing process, according to the multifunctional hard packing box designed by the present invention, the peripheral box walls are connected with each other by use of the "Ω" type hinges, and fixed by rivets through the "Ω" type hinge holes. There are locking clips fixed at the top end of two blades of the hinges. There is an open ring fixed at the upper end of the box walls; The peripheral edges of the box cover and box bottom are fixed with one-pass moulding grooved metal rims by rivets. In the mean time, there are locking teeth fixed at the inner corner angles of the box bottom and box cover; When in use, the box body is pushed off, the upper and lower peripheral edges of the box body are inserted into the box cover, box bottom and the metal grooves of the inner rims, then it is buckled, the locking clips and the locking teeth are buckled and locked with each other. When it is intended to open the box, the open ring is taken out, the locking clips are pushed away by the top end of the open ring, once the locking clips are pulled out of the upper box cover or the box bottom, the box can be opened. Some traces will remain on the box cover which are not recoverable. In the transporting the empty, the box body is closed in randomly from left or right and together the box cover and box bottom, it is to transport in the manner of stackup. This packing box is simple to make at a lower cost, convenient to transport with less space, has a good safety feature, and it can also be in full play which the imitation and steal are prevented.

What is claimed is:

1. A multifunctional hard packing box, comprising a plurality of peripheral box walls which are connected with each other by a plurality of "Ω" type hinges, wherein said "Ω" type hinges each having a plurality of hing holes provided thereon through which said plurality of "Ω" type hinges are affixed to said plurality of peripheral box walls by a plurality of rivets respectively, an upper box cover having a plurality of peripheral edges respectively affixed with a plurality of one-pass moulding grooved metal rims by rivets, a lower box bottom having a plurality of peripheral edges respectively affixed with another plurality of one-pass moulding grooved metal rims by rivets, a plurality of licking clips being affixed by rivets at an upper and a lower end of two blades of said "Ω" type hinges respectively, wherein a plurality of locking teeth being affixed in a predetermined place where corner angles inside said upper box cover and said lower box bottom are coinciding with a pretermined place where said locking clips are affixed on said "Ω" type hinges, said locking clips and said locking teeth being meshed and locked with each other.

2. A multifunctional hard packing box, as recited in claim 1, further comprising an open ring affixed at an upper end of each of said box walls.

* * * * *